United States Patent [19]

Douez

[11] Patent Number: 4,745,634

[45] Date of Patent: May 24, 1988

[54] SINGLE GARMENT, DESTINED PARTICULARLY FOR CHILDREN HAVING MEANS TO ENABLE THE USE OF SUCH WITHOUT HAVING TO SLIP INTO SAID GARMENT

[76] Inventor: Françoise Douez, 1 rue du Surmelin, 75020 Paris, France

[21] Appl. No.: 875,183

[22] Filed: Jun. 17, 1986

Related U.S. Application Data

[63] Continuation-in-part of Ser. No. 786,084, Oct. 10, 1985.

[30] Foreign Application Priority Data

Jun. 26, 1985 [FR] France ..... 85 09738
Nov. 18, 1985 [FR] France ..... 85 17021

[51] Int. Cl.[4] ..... A41B 13/06; A41D 11/00

[52] U.S. Cl. ..... 2/69; 2/80; 2/243 B

[58] Field of Search ..... 2/69, 70, 80, 114, 243 B, 2/DIG. 6, DIG. 7

[56] References Cited

U.S. PATENT DOCUMENTS 1,202,332 10/1916 Tschirgi ..... 2/243 B
1,372,189 3/1921 Pollock ..... 2/243 B
1,475,892 11/1923 Sohn ..... 2/69
3,568,213 3/1971 Mason ..... 2/114
4,258,440 3/1981 McGowan ..... 2/114
4,304,006 12/1981 Swart ..... 2/114
4,382,303 5/1983 Lunt ..... 2/DIG. 7

FOREIGN PATENT DOCUMENTS 1480026 3/1965 Fed. Rep. of Germany .
1460026 2/1969 Fed. Rep. of Germany .
1577493 6/1969 France .
197665 3/1920 United Kingdom ..... 2/243 B

*Primary Examiner*—Werner H. Schroeder
*Attorney, Agent, or Firm*—Larson and Taylor

[57] ABSTRACT

The aim of the invention is a garment characterized by the fact that it comprises a single piece of material which before dressing the baby is a flat surface in substantially the shape of a cross having four projecting parts (**1+2, 3+3*a*, 4+4*a*, 5**) have substantially quadrilateral forms, and in which:

a system of fasteners (7, 8, 9, 10) equipping said upper part (1 and 2) and the lower part so that the lower part (5) may be attached to the upper part (1 and 2);

the intersection between one of the free sides, substantially parallel to the transversal axis of a lateral part and one of the free sides substantially parallel to the longitudinal axis of one of an upper element above defined, having a shape of sufficient surface (**11*b*, 12*b*, 13*b* and 14*b***) to be introduced under the armpit;

the internal surface of the garment, directly in contact with the skin of the child having appropriate properties to be well tolerated by the child.

29 Claims, 12 Drawing Sheets

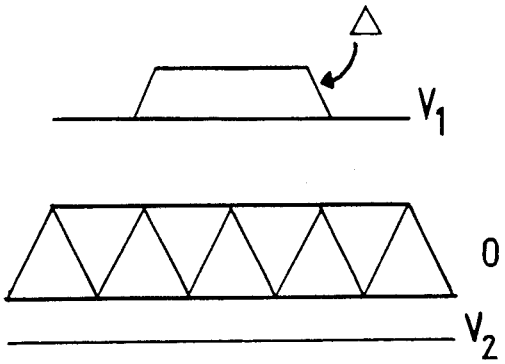
FIG. 12.1
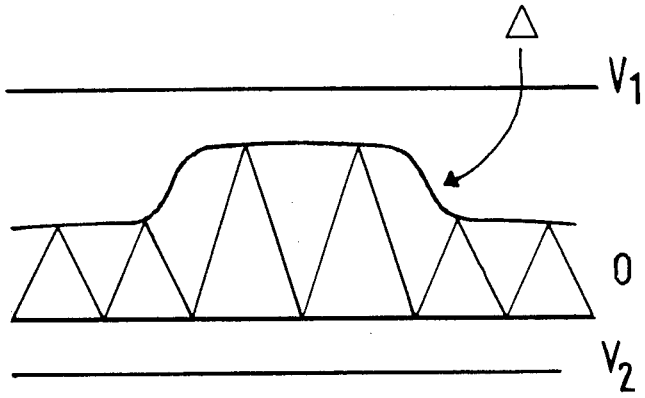
FIG. 12.2

SINGLE GARMENT, DESTINED PARTICULARLY FOR CHILDREN HAVING MEANS TO ENABLE THE USE OF SUCH WITHOUT HAVING TO SLIP INTO SAID GARMENT

This application is a continuation-in-part of Ser. No. 786,084, filed Oct. 10, 1985, now pending.

FIELD OF THE INVENTION

The invention relates to a single garment, intended particularly for children and infants, and more particularly for new born babies, which does not require slipping said cloth over the head and slipping the arms into said cloth.

The invention also relates to a single garment, likely to be worn by adults.

BACKGROUND OF THE INVENTION

There are many clothes for infants and babies, but they do no meet the specific needs of the child in early childhood and more particularly do not meet the needs of the new born baby.

The clothes which are known so far are the following ones:

baby's sleeved vest (or sleeved undershirt) in cotton or cotton with a raised nap which is worn next to the skin of the baby, but this garment necessitates slipping the arms of the baby into it, which is difficult; the fastening of the garment in the back is not very trustworthy and requires lifting the baby's back to try to fasten the vest;

vest (or undershirt) which eliminates the disadvantage of the fastening in the back, but has the disadvantage of having to be slipped over the head, which thereby creates an uncomfortable situation for the new born (who is particularly sensitive to uncomfortable situations created by slipping a garment over his head) and he starts crying;

woollen baby's sleeved vest or backtie kimono ("cache-coeur") the fastening of which is in the back and is constituted either by a string which is knotted, at the neck of the baby or in a crossed shape which can be fastened on the chest of the baby ("cache-coeur"); in both cases, it is necessary to slip the arms into the sleeves, which have to be slipped over the sleeves of the sleeved vest in cotton or cotton with a raised nap, or in thread, and to turn the child around to fasten the garment either in his back or on his chest;

breeches, trousers or pants in cotton or wool, are stepped into and cover the diapers or the diaper pants; in both cases, it is necessary to lift the pelvis of the baby, to put the garment under the buttocks of the baby;

socks or booties in wool or in thread;

"gigoteuse" or one piece footed pajamas or footed stretch overalls in knitted cotton, knitted towelling or wool, which are clothes covering the body of the baby from his head to his foot; these clothes present the drawback of having to slip the arms and legs into them and must, most of the time, be fastened at the back of the baby, which makes it necessary to turn the baby around.

Moreover, the subsequent layers of these different clothes do not always give the desired thermal effect.

They have the drawback of a repetitive manipulation, unpleasant for the baby and for the parent who is fearful of dressing the baby, particularly when the aim is to create a pleasurable relationship between the baby and the parents and also to facilitate tending to the baby's needs.

There is so far, no garment of a new conception avoiding manipulation of the baby and which combines several textile layers of different properties, necessary and sufficient for the warmth required for the baby.

SUMMARY OF THE INVENTION

The applicant provides a garment which, in the great simplification of the dressing, has a large advantage by eliminating the fear of the parents and thus bringing ease into the new relationship with the new born baby.

The importance of this element is proved today and pointed out by the whole pediatric department, in France and abroad.

One of the aspects of the invention is to provide a single garment, which does not require being slipped over the head and which does not require slipping the arms and legs into this garment and which is likely to be well adapted for adults and more particularly for children.

One of the aspects of the invention is to provide a single garment, which meets more particularly the needs of the children, particularly babies, and more especially new born babies.

Another of the aspects of the invention is to provide a single garment, with no seam in the back, which avoids the superposition of different elements such as sleeved vests, undershirts, vests, etc. which are used currently to dress new born babies.

Another aspect of the invention is to provide a single garment which avoids the unpleasant manipulation for the new born babies, since it eliminates slipping over the head, and slipping the arms into the garment and does not require turning the baby around to dress him.

Another of the aspects of the invention is to provide a single garment which gives the warmth necessary for the new born babies, according to the seasons.

Another of the aspects of the invention is to provide a single garment, avoiding all the drawbacks of manipulation such as slipping over the head and turning the baby around, yet enabling one to easily change the diapers of the baby.

Another aspect of the invention is to provide a single garment which enables the baby to move freely, while still keeping the warmth he needs.

Another aspect of the invention is to provide a garment which dispels the fear of the parents, when dressing the new born baby and which is easy to use for dressing children.

Another aspect of the invention is to provide a single garment, particularly for children, which can comprise diaper or diaper pants equipped with means such that said diaper or diaper pants are fastened releasably or not to the garment.

Another aspect of the invention is to provide a single garment for adults or children, which can comprise areas which have physiologically adapted characteristics enabling them to act as a support for therapeutical products, and which also have characteristics of permeability with respect to the migration of the therapeutical products so that these latter are in contact with the skin.

More particularly, the object of the invention is to provide a baby garment characterized by the fact that it comprises a single piece of material, which before dressing the baby is a flat surface in substantially the shape of a cross, having a longitudinal axis and a transversal axis in which the four projecting parts have substantially quadrilateral forms, particularly trapezoidal or rectangular, of which three of their sides are free and the fourth adjoins the rest of the material, and in which:

two of these quadrilaterals extending from each other and crossed by the transversal axis—thus forming the lateral part—are identical, and the crease of these lateral parts, approximately along the transversal axis or along an axis substantially parallel to the transversal axis and hereafter designated "shoulder crease axis", allows the upper edges respectively of these two lateral parts to be brought together with their respective lower borders to form the sleeves, the upper and lower borders respectively of each of the lateral parts being equipped with a system of fasteners allowing the upper and lower edges of each of the lateral parts to be held together;

the upper part which after dressing forms the front of the garment, crossed by the longitudinal axis is split substantially along the longitudinal axis or along an axis substantially parallel to the longitudinal axis, from the upper edge of the uppe part to the centre of the cross, which is a substantially circular hole whose circumference roughly corresponds to the size of the baby's neck, this upper part is thus formed of two elements whose dimension is such that when the two elements are folded or pulled down (over the shoulders) along the axis of the shoulder crease defined above, the baby's body is covered over a length going from his neck to at least his abdomen and across the entire width of the front of his body, each of these two upper elements being equipped along their respective edge of the aforesaid split, with a system of fasteners permitting them to be attached together when folded over the front of the baby's body;

the lower part, which after dressing, forms the back of the garment extending from the upper (frontal) part and crossed by the longitudinal axis has a length at least equal to the distance between the neck and the abdomen of the baby and a width substantially corresponding to the width of the baby's back;

a system of fasteners equipping said upper part so that the lower part may be attached to the upper part, once the upper part has been folded down (over the shoulders) to cover the front of the baby's body.

the intersection between one of the free sides, substantially parallel to the transversal axis of a lateral part and one of the free sides substantially parallel to the longitudinal axis of one of an upper element above defined, or one of the free sides substantially parallel to the longitudinal axis of the lower part having a shape of sufficinet surface to be introudced under the armpit and to provide the perfect closing of the sleeves, of the front part and of the back part of the garment, without hampering the child's movements;

the internal surface of the garment, directly in contact with the skin of the child having appropriate properties to be well tolerated by the child;

the garment comprising at least a layer of kind and of thicknes such that the body of child is in the appropriate warmth.

The terms "single piece of material" is defined as a surface of material liable to comprise for instance seams and cuttings, but comprising no parts liable to be slipped over the head or into which one slips the arms or the legs of the child, such as the pre-shaped sleeves, pre-shaped les, pre-shaped pants or pre-shaped vest.

The terms "substantially the shape of a cross" are defined as a surface, the figure of which is a geometrical shape comprisingg four projecting parts, or convex lobes, in which a longitudinal axis can be defined, along which the baby is laid for dressing and a transversal axis along which the arms of the babies can be put during the dressing up procedure.

But the terms "substantially the shape of a "cross" must not be limited to the shape of a cross, such as usually defined, but also encompassing the geometrical shapes, the projecting parts of which do not present sharp angles, but all the intersections between the different edges are rounded, the projecting parts forming thus lobes or petals.

At the intersection between the transversal axis and the longitudinal axis, the centre of the cross comprises a hole which is substantially circular on which the head of the baby is placed during dressing.

A substantially parallel direction with respect to the longitudinal (or transversal) axis is hereafter defined as a direction, the generating vector of which presents an angle with respect to the longitudinal (or transversal) axis lower than 45°.

When the baby has been laid along the longidutinal axis, the baby's head is on the hole (centre of the cross), the baby's back is situated on the lower lobe which will hereafter be called "lower part".

The lobe situated above the baby's head is called "upper part".

The two lobes on which the arms of the baby are placed whilst dressing are called "lateral parts".

The aim of these lateral parts is to form sleeves and they are identical as to their shape and their surface.

These lateral parts have substantially quadrilateral shapes, particularly trapezoidal or rectangular and present three of their sides (or edges) free whereas the fourth side is engaged in the rest of the piece of material.

The three free sides of these lateral parts are linear but can be curved or present one or several enlargements or cuttings.

The two sides of these lateral parts which are substantially parallel with respect to the transversal axis, can advantageously comprise enlargements, whereas the side of these lateral parts which is substantially parallel with respect to the longitudinal axis is preferably curved.

The intersection hereabove defined corresponds to the intersection between the free side, substantially parallel to the longitudinal axis of an upper element (but which does not correspond to the split of the upper part) and the free side substantially parallel to the transveral axis of a lateral part, and/or to the intersection between the free sides substantially parallel to the longitudinal axis of the lower part and the free side substantially parallel to the transversal axis of a lateral part.

This intersection between the above defined sides does not form a sharp angle but is constituted by a surface of material which is used as a junction or as an overlapping between the above defined sides.

This surface of material can be limited by an edge which can be linear or curved, or comprise enlargements or cuttings.

This surface of material advantageously presents a convex shape, particularly round.

This surface of material must be of a large enough size, so that after folding over the upper element along the front of the child and the lateral part along the shoulder crease axis, it can be introduced under the child's armpit in order to provide a tightness between the sleeve, the back and the front of the child even when the child raises his arms.

Advantageously, the intersection between the free side substantially parallel to the longitudinal axis and opposed to the split of an upper element as hereabove defined and the free side substantially parallel to the transversal axis of a lateral part, has a convex shape so that when the lateral parts, on one hand, are folded over along the shoulder crease axis in order to form the sleeves, and on the other hand, the upper part is folded over in order to form the front of the garment, a piece of material is obtained and is then introudced under the child's armpit in order to have a perfect closing of the sleeve, the front end and the back of the garment.

The phase "perfect closing" here means the overlapping by means of the said part introduced under the chld's armpit, between the sleeve, the front and the back of the garment, which avoids any part of the child's body, near the armpit, to be uncovered especially when the child moves, particularly when he raises his arms.

According to another embodiment of the invention, each of the intersections of the free sides substantially parallel to the transversal axis, can comprise a surface of material of appropriate thickness not to cause any uneasiness or hampering due to a too thick piece of material under the armpit area.

The transversal axis of these above defined lateral parts preferably corresponds to the place where the shoulder line of the child is located when dressing him.

The upper edge or side of these lateral parts is folded over along the shoulder line, also designed as the "shoulder crease axis", to bring the upper edge (or side) of each of these lateral parts on to the lower edge (or side) and thus to form the sleeves.

These sleeves can be short or long according to the size of these lateral parts.

The lower and upper edges according to the transversal axis of each of the lateral parts are equipped with a system of fasteners to keep the sleeve closed.

The lateral parts may or may not comprise seams.

The seam advantageously marks the shoulder line as above defined.

The upper part has also a quadrilateral shape, particularly trapezoidal or rectangular.

The upper part is split along its entire length from the upper border, i. e. from the upper edge parallel to the transversal axis down to the circular hole which thus delimitates the two upper elements.

Each of the upper elements comprises three free edges of sides, two of which are substantially parallel to the longitudinal axis and the other is substantially parallel to the transversal axis.

One of the free sides of the lower element is substantially parallel to the longitudinal axis corresponds to the slit of the upper part.

The fourth side of each of the upper elements is engaged in the rest of the piece of material.

The free sides of each of the upper elements can be linear, but can also be curved or comprise enlargements and cuttings.

Advantageously, the free side which is substantially parallel to the transversal axis of one of the upper elements is bigger than the corresponding free side of the other element, so that when the two upper elements are folded over along the shoulder axis, after placing the baby as mentioned above, these two elements covering the front of the baby at least down to this abdomen can be fastened together.

The aim of this is to efficiently fasten the part of the garment on the front of the baby.

The size of the free side which is substantially parallel to the transveral axis of each of the upper elements is equal to about half the size of the width of the front of the baby's body.

The internal surface of the cloth is bound to be directly in contact with the child's skin and must then present properties such that the baby's skin properly tolerates this direct contact.

In fact, the internal surface must not ignore or itch the childs's skin but on the contrary must present a comfortable and a pleasant feeling for the skin, must be of a material presenting non-allergic properties.

Besides, the nature of the material must be such that it provides to the child enough warmth, according to the temperature of the atmosphere in which the child is and preferably such that it protects the child from the possible shocks.

A system of fasteners is fixed on the respective sides of the upper elements on the side of the split.

A system of fasteners can also be advantageously located on the free borders which do not mark the split, but which are substantially parallel to the longitudinal axix of each of the upper elements, in order to fasten the upper elements to the lower part which constitutes the back of the garment.

A system of fasteners can be also fixed on the respective borders which are substantially parallel to the transversal axis of the upper elements, to possibly fasten the upper elements to an element formed in the lower part of the garment.

The lower part comprises a longitudinal axis along which the back of the baby is laid. This lower part comprises two free sides , which are substantially parallel to the longitudinal axis, a third side which can be free or which can be engaged in the rest of the piece of the garment according to the embodiment of the bottom of the garment.

The distance between the two free sides of this lower part corresponds substantially to the width of the back of the baby.

The free sides can be linear or curved.

They can advantageously comprise cuttings or enlarged parts.

With this garment, it is possible to place the baby on the completely unfolded garment and to dress the baby by folding the different mentioned parts to make the sleeves and the front of the garment over him, to fasten them together without slipping the garment over the head and without the arms being slipped into the garment and without needing to turn the baby around.

According to a preferred embodiment, the lateral parts are such that the free side of each, which is substantially parallel to the longitudinal axis, is equipped with a strap of material which is closed, or capable of being closed on itself, independently from the lateral part according to a circular shape in a perpendicular plane with respect to the plane on which the garment is unfolded.

This circular strap makes it possible to surround the wrist or the writst and forearm of the baby; thus, when dressing up the baby, after pulling him on the completely unfolded garment along the longitudinal axis of the garment, the two circular straps are slipped over the hands or the hands are slipped into the straps, so that the straps surround the wrists of the baby, which makes dressing the baby easier, mostly when he moves his arms.

The width of the material straps must not be too thin, so that they are solid enough to resist the efforts of the baby's wrist, and their maximum width must be such that when slipping the wrist or the wrist and forearm into the strap, this movement requires only a minimum of effort.

The circular straps are advantageously the width of the baby's wrists, but their width can vary between about 0.3 cm to about 4 cm.

The material of these circular straps can be identical with respect to that of the rest of the garment. But it can be advantageously constituted of a stretch material which is appropriate for the skin, the morphology and the comfort of the baby. As appropriate materials, one may resort to ribbed material, the ribs of which provides for a certain elasticity.

According to a preferred embodiment, all the projecting parts of the garment, when it is completely unfolded are advantageously such that the intersections between the free sides are not at acute angles, but are rounded or present an aesthetical cutting.

Preferably, the intersection between the different free sides of each of the projecting parts is rounded, so that each of the projecting parts of the garment has for instance the shape of a petal, the embodiment of which is nevertheless adapted for the dressing by folding over the different parts as it has been mentioned above.

According to a preferred embodiment of the invention, some parts of the garment comprise elastic material areas, in order to improve the comfort of the child when he makes movements.

These areas of elastic material advantageously constitue the surfaces which are situated under the armpits, as well as the parts of the garment in the area of the shoulders.

For instance, the surfaces of the material which are introduced under the armpit are of elastic material and are advantageously in the prolongation of an elastic material strap which goes from the neck of the child according to the direction which follows the raglan line.

As elastic material, one may use a knitted material, such as knitted cotton fibers or knitted synthetic fibers.

According to a preferred embodiment, the garment of the invention is constituted of a single piece of material which before dressing the baby is a flat surface, substantially in the shape of a cross, having a longitudinal axis and a transversal axis in which the four projecting parts have approximately quadrilateral forms, particularly trapezoidal or rectangular, of which three of their sides are free and the fourth adjoins the rest of the material, and in which:

two of these quadrilaterals extending from each other and crossed by the transversal axis—thus forming the lateral parts—are identical and the crease of these lateral parts approximateely along the transversal axis, or along an axis approximately parallel to the transveral axis and hereafter designated "shoulder crease axis", allows the upper edges respectively of these two lateral parts to be brought together with their respective lwoer borders to form the sleeves, the upper and lower borders respectively of each of the lateral parts being equipped with a system of fasteners allowing the upper and lower edges of each of the lateral parts to be attached together;

the upper part which after dressing forms the front of the garment, crossed by the longitudinal axis, is split approximately along the longitudinal axis or along an axis approximatly parallel to the longitudinal axis, from the upper edge of the upper part to the centre of the cross, which is an approximate circular hole whose circumference roughly corresponds to the size of the baby's neck, this upper part is thus formed of two elements whose dimension is such that when the two elements are folded or pulled down (over the shoulders) along the axis of the shoulder crease defined above, the baby's body is covered over a length going from his neck to at least his abdomen and across the entire width of the front of his body, each of these two upper elements being equipped along their respective edge of the aforementioed split, with a system of fasteners permitting them to be attached together when folded over the front of the baby's body;

the lower part, which after dressing, forms the back of the garment, extending from the upper part and crossed by the longitudinal axis, has a length varying substantially from the baby's length (measured from neck to feet) of about twice the baby's length (measured from neck to feet), and a width substantially corresponding to the width of the baby's back, said lower part being able to be folded up along an axis approximately parallel to the transversal axis, situated at a distance from the centre of the piece of the material equal to around the distance from the neck to the baby's feet, this axis substantially parallel to the transversal axis being hereafter designated "axis of the foot crease", the element of the lower part thus folded upward from the feet having a length less than or equal to the distance from the feet to the neck;

a system of fasteners equipping the lower part so that the lower part may be attached to the upper part when the upper and lower parts are both folded over to cover the front of the baby's body;

and a system of fasteners so that the element of the lower part folded up over the front of the baby's body may be joined to the corresponding element of the lower part which covers the baby's back;

the intersection between one of the free sides, substantially parallel to the transversal axis of a lateral part and one of the free sides substantially parallel to the longitudinal axis of one of an upper element above defined, or one of the free sides substantially parallel to the longitudinal axis of the lower part having a shape of sufficient surface to be introduced under the armpit and to provide the perfect closing of the sleeves, of the front part and of the back part of the garment, without hampering the child's movements;

the internal surface of the garment, directly in contact with the skin of the child having appropriate properties to be well tolerate by the child;

the garment comprising at least a layer of kind and of thickness such that the body of child is in the appropriate warmth.

In this embodiment, the two legs of the baby are not separated.

According to another embodiment, the garment according to the invention is shaped so that the lower part is equipped with a longitudinal split arranged symmetrically relative to the axis of the foot crease, and the half-length of which is equal to approximately the distance between the feet and the crotch of the baby permitting after having folded the said lower part up along the axis of the foot crease to form accomodations for the legs and feet of the baby, the edges of this split are equipped with a system of fasteners allowing the parts of the edges which are symmetrical relative to the foot crease to be held together.

In this embodiment, the two legs of the baby are individually covered. The width of the accomodation for the feet and legs of the baby can be chosen as desired.

According to another embodiment, the garment according to the invention is such that the lower part includes pants, the leg ends of which are open or closed (depending on whether the baby's feet are covered or not) and whose lower elements of the sides of the pant legs from the foot or from the ankle to around the calf are pre-attached to each other, whereas the upper elements of the sides of the pant legs, from the calf to the upper edge of the pants are equipped with a system of fasteners to attach together the frontal and dorsal parts of the pant legs and so that the upper part of the pants can be equipped with a system of fasteners to attach together the top of the pants and the upper part of the garment also equipped with a system of the garment, when it is folded down over the baby.

In this embodiment, the lower part of the pants is pre-attached, for instance sewn, on a length which goes from about the end of the feet to about the ankle or on a length going from about the ankle up to about the calf, whereas the respective edges of each of the trouser legs, from about the calf to the upper edge of the pants, i. e. up to the abdomen for the external edges and up to the crotch for the lower edges, are free before dressing the baby. These edges are fixed to each other to gath the dorsal and frontal part of each of the trouser legs by a system of fasteners.

Advantageously, the lower edges of the dorsal and frontal part of the legs of the pants, going from the foot or the ankle up to the crotch are pre-attached, for instance sewn.

In this case, for dressing the baby, the feet are slipped into the garment and it is possible to put clean diapers on the baby without taking off the pants, whilst the upper part of the garment remains in its place.

In this embodiment, the lengght of the legs of the pants measured along the external sides, can vary from the calf to the abdomen and particularly vary from the knee of the baby up to his abdomen, or from any point of the thigh of the baby up to the baby's abdomen.

According to a preferred embodiment, the garment of the invention has the shape practically of a symmetrical cross relative at the same time to its transversal axis and longitudinal axis in which:

the upper part is such that each of the two upper elements has a length at most equal to the length of the child, measured from neck to feet and including along a length at most equal to around the length of the baby's leg and at least around a quarter of the length of the baby's leg, an approximately rectangular element which is set back relative to the split, the lower part has a length at most equal to the baby's length measured from neck to feet, this lower part including on a length at most equal to the length of the baby's leg and at least around a quarter of the length of the baby's leg two substantially rectangular, identical elements, and identical with the two substantially rectangular elements of the upper part and, for one thing, separated from each other by a split, and for another, recessed relative to the longitudinal axis, and in which after the folding down from the shoulder crease of the upper part, each of the substantially rectangular elements of the upper part covers each of the substantially rectangular elements of the lower part to form pants whose leg length varies according to the length of the various said rectangular parts.

According to another preferred embodiment of the invention the garment according to the invention is such that below the two lateral parts of the cross are two additional lateral parts, which will also be hereafter designated by the name "tabs", located substantially perpendicularly to the longitudinal axis and substantially parallel to the transversal axis, located along the sides of the lower part, which are substantially parallel to the longitudinal axis, between the lower edge of the lateral parts which form the sleeve and the place of the lower part, which corresponds to the bottom of the baby's back.

These two parts of material constitute additional lateral parts which can be folded over each other, along a substantially parallel direction of the transveral axis.

They are located so that they advantageously cross on the baby's stomach and comprise a system of fasteners enabling them to be attached together and they are advantageously equipped with a systme of fasteners enabling them to be attached on the front of the baby's garment.

They are advantageously shaped like parallelepipedic rectangular or trapezoidal straps, and wherein the ends of which, which cross each other, can be curved and comprise one or more enlargements or cuttings.

According to a preferred embodiment, the garment according to the invention is such that the two elements of the upper part have sizes from about 11 cm to about 20 cm, in particular about 18 cm, parallel to the transversal axis from about 22 cm to about 40 cm, in particular about 32 cm, parallel to the split, the length of the split is about 22 cm to about 40 cm, in particular 32 cm, the lateral parts are about 22 cm to about 38 cm, in particular 32 cm, parallel to the transversal axis, from about 20 cm to about 35 cm, in particular 30 cm, parallel to the longitudinal axis, the lower part is from about 40 cm to about 70 cm, in particular about 65 cm, parallel to the longitudinal axis, from about 22 cm to about 38 cm, in particular about 32 cm, parallel to the transveral axis, the straps are from about 10 cm to about 15 cm, parallel to the transversal axis and about 10 cm to about 20 cm, parallel to the longitudinal axis, the circumference of the hole for the passage of the neck is about 30 cm. These measures vary of course according to the age and the size of the child.

The garment according to the invention can also have dimensions appropriate to the morphology of any adult, child or baby and in particular appropriate to a new born baby up to a 6 year old child.

The different edges, borders, or sides above defined, can be linear, but can also be curved or comprise enlargements or cuttings.

These enlargements or cuttings are advantageously used to attach thereon systems of fasteners.

The systems of fasteners used can be the ones conventionally utilized in the ready made garment, particularly for children.

They are advantageously chosen among buttons, press-studs, zips, straps, ribbons, adhesives, strips commercialized under the name Velcro strips.

Velcro in various forms will advantageously be resorted to.

Such velcro strips will advantageously be attached at one or several points of the parts to be held together and preferably attached along the whole length of the sides of the parts to be held together.

Of course, the dimensions which are given relative to the different parts do not take into account the enlarged parts, cuttings or straps of material, which are possibly added for the comfortable wearing of the garment, for the making up and the aesthetical aspect of the garment, or to improve the location of the system of fasteners.

The material which is used for making said garment comprises advantageously two layers of different material, and generally of different nature:

a layer of material which will be put in contact with the skin of the baby and which presents nonallergenic properties and which is appropriate for the skin of children;

a layer of material, which preferably presents thermal properties, situated on the material which is direclty in cotact with the skin of the baby and is to bring sufficient warmth for the child.

As appropriate materials for babies' skin, one may cite cotton, cotton veil, cotton knit, towel knit, linen, flannel, lined material or silk.

As materials presenting thermal properties, one may cite particularly clorofibre, which presents triboelectrical properties.

The garment can also comprise a layer of material, or of synthetic or artificial material, which can also play an aesthetical part. This layer of material can replace the layer of material presenting thermal properties or can advantageously constitute a third layer situated on the layer presenting the thermal properties. This layer can, for instance, be constituted of cotton, cotton veil, cotton knit, towel, towel knit, wool, polyester, acrylic, polyadmide, polyamide 6—6, polyamide aramid, material with raised naps, viscose, acetate, triacetate, modal, this list being not limitative.

According to the season, one resorts to the thickness and to the appropriate material of the layers of the material to be used.

This garment according to the invention can also be of non woven material, which enables one to throw away the garment after use; thus the garment according to the invention is a disposable garment.

This garment according to the invention can also be such that the internal material, which is directly in contact with the baby's skin, is removable from the rest of the garment so that it can be changed when necessary.

This internal material which is directly in contact with the baby's skin, and which can be removed from the rest of the garment will advantageously be non woven.

According to an advantageous embodiment of the invention, the garment according to the invention can also comprise a hood which can be removed or not from the rest of the garment, preferably attached to the circular hole which has been above defined or in a place located next to the shoulder crease axis, said hood being intended to cover the child's (or adult's) head.

The aim of the invention is also to provide any garment for children which has the above mentioned characteristics in which, when the garment is completely unfolded, the child is placed on his stomach to be dressed up, the upper part (which, in the above defined embodiments, is the front of the garment) corresponds to the back of the garment and the lower part (which, in the above defined embodiments, is the back of the garment) corresponds to the front of the garment.

According to a preferred embodiment of the invention, the garment comprises a single piece of material which before dressing the baby is a flat surface in substantially the shape of a cross, having a longitudinal axis and a transversal axis in which the four projecting parts have substantially quadrilateral forms, particularly trapezoidal or rectangular, of which three of their sides are free and the fourth adjoins the rest of the material, and in which:

two of these quadrilaterals extending from each other and crossed by the transversal axis—thus forming the lateral parts—are identical and the crease of these lateral parts approximately along the transveral axis or along an axis substantially parallel to the transversal axis and hereafter designated "shoulder crease axis", allows the upper edges respectively of these two lateral parts to be brought together with their resepctive lower borders to form the sleeves, the upper and lower borders respectively of each of the lateral parts being equipped with a system of fasteners allowing the upper and lower edges of each of the lateral parts to be held together;

the upper part which after dressing forms the back of the garment, crossed by the longitudinal axis, is split substantially along the longitudinal axis or along an axis substantially parallel to the longitudinal axis, from the upper edge of the upper part to the centre of the cross, which is a substantially circular hole whose circumference roughly corresponds to the size of the baby's neck, this upper part is thus formed of two elements whose dimensions are such that when the two elements are folded or pulled down (over the shoulders) along the axis of the shoulder crease defined above, the baby's body is covered over a length going from his neck to at least the base of his back and across the entire width of the back of his body, each of these two upper elements being equipped along their respective edges of the aforesaid split, with a system of fasteners permitting them to be attached together when folded over the back of the baby's body;

the lower part, which after dressing, forms the front of the garment extending from the upper (dorsal part and crossed by the longitudinal axis, has a length at least equal to the distance between the neck and the base of the baby's back and a width substantially corresponding to the width of the baby's front;

a system of fasteners equipping said upper part and the lower part so that the lower part may be attached to the upper part, once the upper part has been folded down (over the shoulders) to cover the back of the baby's body;

the intersection between one of the free sides, substantially parallel to the transversal axis of a lateral part and one of the free sides substantially parallel to the longitudinal axis of one of an upper element above defined, or one of the free sides substantially parallel to the longitudinal axis of the lower part having a shape of sufficient surface to be introduced under the armpit and to provide the perfect closing of the sleeves, of the front part and of the back part of the garment, without hampering the child's movements;

the internal surface of the garment, directly in contact with the skin of the child having appropriate properties to be well tolerated by the child;

the garment comprising at least a layer of kind and of thickness such that the body of child is in the appropriate warmth.

The invention also provides a single garment for adults or children which comprises means so that the diaper or the diaper pants, which are releasably or not fixed to said garment or so that one or several areas are releasably or not fixed to said garment, which areas have such characteristics that they are the support for therapeutical substances and that they allow the migration of these therapeutical substances so that these latter are in contact with the skin.

The diaper or diaper pants (which can be removed or not) can be fixed on the internal surface of the garment directly in contact with the child's skin.

When the garment is made of woven material, the diaper or diaper pants can be fixed in a unreleasable way for instance stuck or sewn on the internal surface of the garment.

When the garment is made of woven material, the diaper or diaper pants can be fixed in a releasable way on the internal surface of the garment.

The diaper or diaper pants can be attached, for instance, with buttons, press-studs, adhesives, strips commercialiazed under the name of velcro, ribbons or straps.

In this case, the diaper or diaper pants can be made of washable material, but advantageously they will be made of non-woven material and be disposable.

When the garment for children is made of non woven material, it can be made of at least two layers and comprise, on the internal surface, a diaper or diaper pants made of non-woven material, fixed in a unreleasable way, for instance stuck or sewn, or fixed in a releasable way, for instance without button, pressstuds, adhesives, strips commercialiazed under the name of velcro, ribbons or straps.

The garment, according to the invention, can advantageously be made of three layers, for instance, a first non-woven veil which forms the internal surface of the garment and which in in direct contact with the skin, a second non woven veil which forms the external surface of the garment and an intermediate layer of non-woven material, the internal surface of the garment comprising a diaper or diaper pants, attached in a non releasable way, for instance stuck or sewn, or attached in a releasable way, for instance with buttons, press-studs, adhesives, strips commercialiazed under the name of velcro, ribbons or straps.

When the garment is made of non-woven material, the diaper or diaper pants can be incorporated (or integrated) within the structure of the single garment.

In other words, the non-woven structure of the garnment of the invention will comprise, at the appropriate place, alternate, absorbent and impermeable layers which generally constitute the diaper or diaper pants.

In other words, if the garment is made of at least two layers, the layer which is situated right under the layer which defines the internal surface, will be modified by the integration of a structure of the type of the diaper or of the diaper pants.

If the single garment made of non-woven material is made for instance of two layers of non-woven veil, (internal veil and external veil) separted by an intermediate layer, particularly made of quilting, the part of the garment on which the diaper or diaper pants are normally supposed to be place, will be modified particularly at the level of the intermediate layer, the latter will be thicker than the intermediate layer in the rest of the garment because of the integration of a structure of the type of the diaper or of diaper pants.

Where the intermediate layer will be modified to integrate the diaper or diaper pants, the internal veil (that which is in direct contact with the child's skin) and the external veil (that which is on the external surface of the garment) can be similar or not to the internal and external veils of the rest of the garment.

Advantageously, the internal veil of the garment will be the same all over the internal surface of the garment.

Advantageously, the external veil of the garment will be in the same all over the external surface of the garnment.

The single garment incorporating or integrating the diaper or diaper pants according to the invention, can be manufactured continuously, that is to say the diaper or diaper pants will be simultaneously integrated to the garment with the manufacture of said garment.

According to a preferred embodiment comprising means so that the diaper or diaper pants are fixed to the garment and can be removed or not, the garment advantageously comprises means to secure the imperviousness of the diaper or diaper pants with respect to the rest of the garment.

These means can be for example an impermeable area which separates the surface of the diaper or the diaper pants from the surface of the rest of the garment.

These means can also be constituted by a set of elements allowing a shrinking of the garment at the appropriate area (i.e elastics, gathers and flounces) which gives to this part of the garment comprising the diaper or diaper pants the shape of pants.

According to another aspect of the invention, the single garment for adults or children can comprise areas which have characteristics physiologically adapted enabling them to act as support for therapeutical products and with permeable characteristics allowing the migration of the product and keeping such in contact with the skin.

These areas can be located any where on the garment and even be spread out all over the surface of the garment.

These areas can be of any square, rectangular, trapezoidal, triangular, circular or oval shape, advantageously adapted to the surface of skin to be treated.

These areas can be located on the internal surface of the garment in direct contact with the skin, and the surface of these said areas can be coated, covered up or impregnated with a threrapeutical product, or this said therapeutical product can be absorbed on the above said areas.

These areas, when located on the internal surface of the garment in direct contact with the skin, can be fastened in a unreleasable way on the above said internal surface, or be fastened, in a releasable way, on the internal surface, or can be integrated in the structure of the above said internal surface.

These said areas can also be located under the internal surface of the garment in contact with the skin, particularly right under the internal surface in contact with the skin, and are physiologically adapted to be coated, covered up or impregnated with a therapeutical product, or allowing a therapeutical product to be adsorbed on their surface, and the surface located above the internal surface must be physiologically adapted to allow the therapeutical product to diffuse and migrate so that it is in contact with the skin of the child or of the adult.

When the single garment for adult or child of the invention is of non-woven material and comprises at least two layers of non-woven material, for instance three layers, of which one is an internal veil, one is an external veil and one is a non-woven intermediate layer, i.e of quilting, this garment can comprise:

areas on the internal veil (removable or not, or integrated to the structure of the internal veil), and/or areas on the intermediate layer, the set of these areas being physiologically adapted to be the support for therapeutical substances and allowing migration and diffusion of this therapeutical product, so that is in contacat with the skin.

These areas intended to have therapeutical products must have physiological, bacteriological and sterility qualities adapted to the skin and to the possible skin wounds. The internal surface in direct contact with the skin will present the same characteristics.

The therapeutical products can be used in preventive or curative treatments of skin lesions, dermatological diseases, eczema itching, pruritus, burns, sunburns, infantile or skin diseases.

These single garments of the invention presenting a therapeutical use are particularly advantageous for hospital cares or treatments at home.

This said garment of the invention intended for a therapeutical use is also adapted in treatments for adults, particularly patients in hospitals or at home, and for whom manipulations must be avoided.

These garments intended for therapeutical use can be of woven material or of non-woven material.

These garments according to the invention comprise specific areas adapted to the patient's situation : i.e operative consequences, giving birth, incontinence (incorporated diaper or diaper pants as described in the garment for child), paralysis, handicaps.

Generally speaking, the garment according to the invention can be used in all situations where dressing and undressing are difficult, i.e bed-ridden patients, old people or immobilized patients.

The list of appropriate therapeutical substances which can be used, comprises all therapeutical products which are liable to be applied as ointments, gel, lotion, foam, cream, and more generally which are liable to be applied with a pharmaceutically, either externally or systemically acceptable vehicle.

BRIEF DESCRIPTION OF THE DRAWINGS

For a better understanding of the invention, as well as other objects and further features of the invention, reference is made to the following detailed description, to be read in conjunction with the accompanying drawings which are illustrative only and not limiting. Further, these drawings are not intended to restrict either the areas supporting the therapeutical substances as indicated in the figures or restrict the areas having diaper or diaper pants as indicated in the figures which are given only by way of example:

FIGS. 12.1 and 12.2 are enlarged, highly schematic sectional view of the present invention at locations which comprise a diaper or diaper pants.

DETAILED DESCRIPTION OF THE PREFERRED EMBODIMENTS

Figure 1:
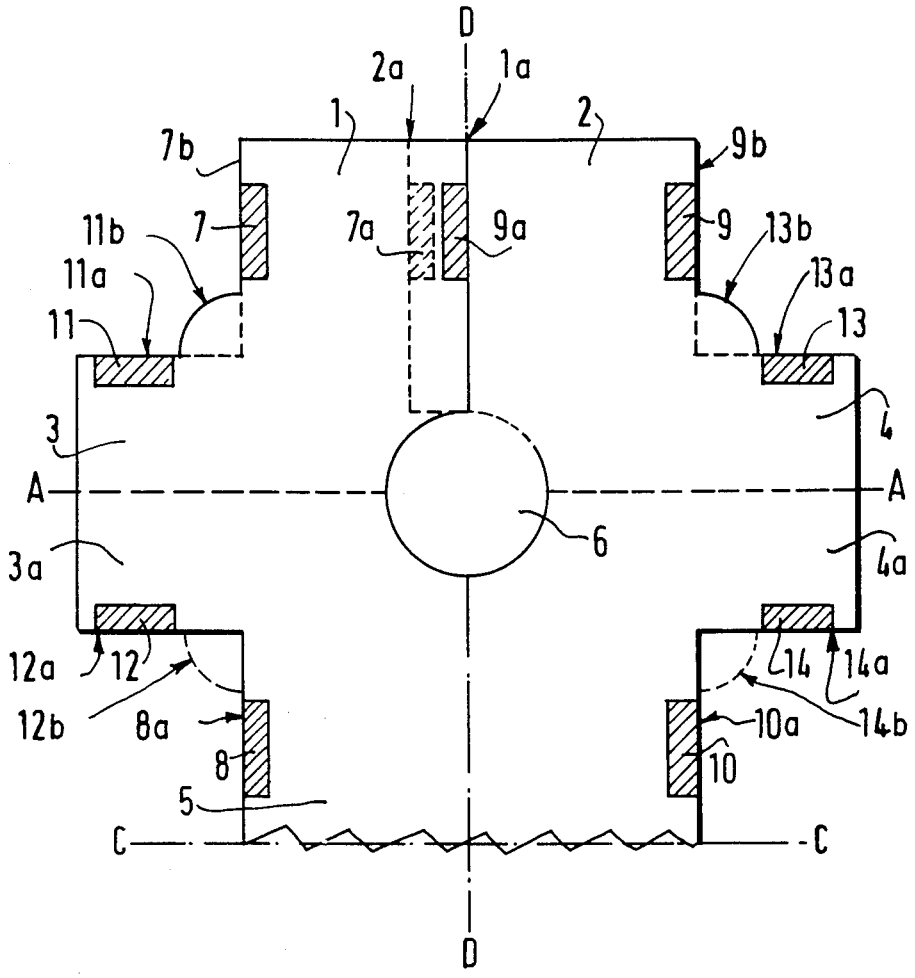
FIG. 1 shows a garment of the present invention, completely unfolded on a plane and comprising fastening means.

FIG. 1 represents a garment according to the invention, completely unfolded on a plane where:

the D—D axis represents the longitudinal axis, the A—A axis represents the transversal axis, the C—C line separates the chest from the legs and the garment can have a lenth going from the hole 6 down to the C—C line, or can have any shape beyond the C—C line;

1 and 2 form the two upper elements of the upper part, and are separated by the split, the edges of which are separated by 1bis and 2*a*, the dotted line 2*a* meaning that the upper element 2 is larger than 1, so that the chest of the baby can be covered;

the upper elements 1 and 2 are folded up along the shoulder crease on the lower part 5;

3, 3*a* on the one hand and 4, 4*a* on the other hand represent the lateral parts, 3 and 4 being over the shoulder crease axis substantially parallel to A—A and, 4 and 4*a* being below the shoulder crease axis substantially parallel to A—A;

3, after it has been folded over 3*a*, forms the sleeve, which is maintained by means of the fasteners 11 and 12, whereas the fasteners 13 and 14 keep the sleeve formed by folding part 4 over part 4*a*;

6 corresponds to the hole for the baby's head;

the fasteners 7 and 8, on the one hand, 9 and 10 on the other hand, are used to maintain the upper elements 1 and 2 on the lower part 5;

and the fasteners 7*a* and 9*a* are used to attach together the two upper elements 1 and 2 when they have been folded up along the shoulder crease axis on to part 5.

For convenience, the upper part will be designated as 1+2, the two lateral parts are respectively designated by 3+3*a* and 4+4*a*, the lower part is designated by 5.

11*b* and 13*b* represent the convex surfaces which are located respectively at the intersection of the edges 7*b* (substantially parallel to the longitudinal axis) but which do not constitue the free side along the split of the upper part and 11*a* (substantially parallel to the transversal axis) on the one hand and of the edges 9*b* (substantially parallel to the longitudinal axis) but which do not constitute the free side along the split of the upper part) and 13*a* (substantially parallel to the transversal axis) on the other hand.

These surfaces 11*b* and 13*b* are limited by a round convex edge represented in continuous line.

A round dotted line represents the sides of the two convex surfaces 12*b* and 14*b* which are respectively at the intersection of the sides 8*a* (substantially parallel to the transveral axis) and 12*a* on one hand (substantially parallel to the transversal axis) and the sides 10*a* (substantially parallel to the longitudinal axis) and 14*a* (substantially parallel to the transversal axis) on the other hand.

The garment of the invention can comprise either the convex surfaces 11*b* and 13*b*, either the convex surfaces 12*b* and 14*b*, or the convex surfaces 11*b*, 12*b*, 13*b* and 14*b*.

Figure 2:
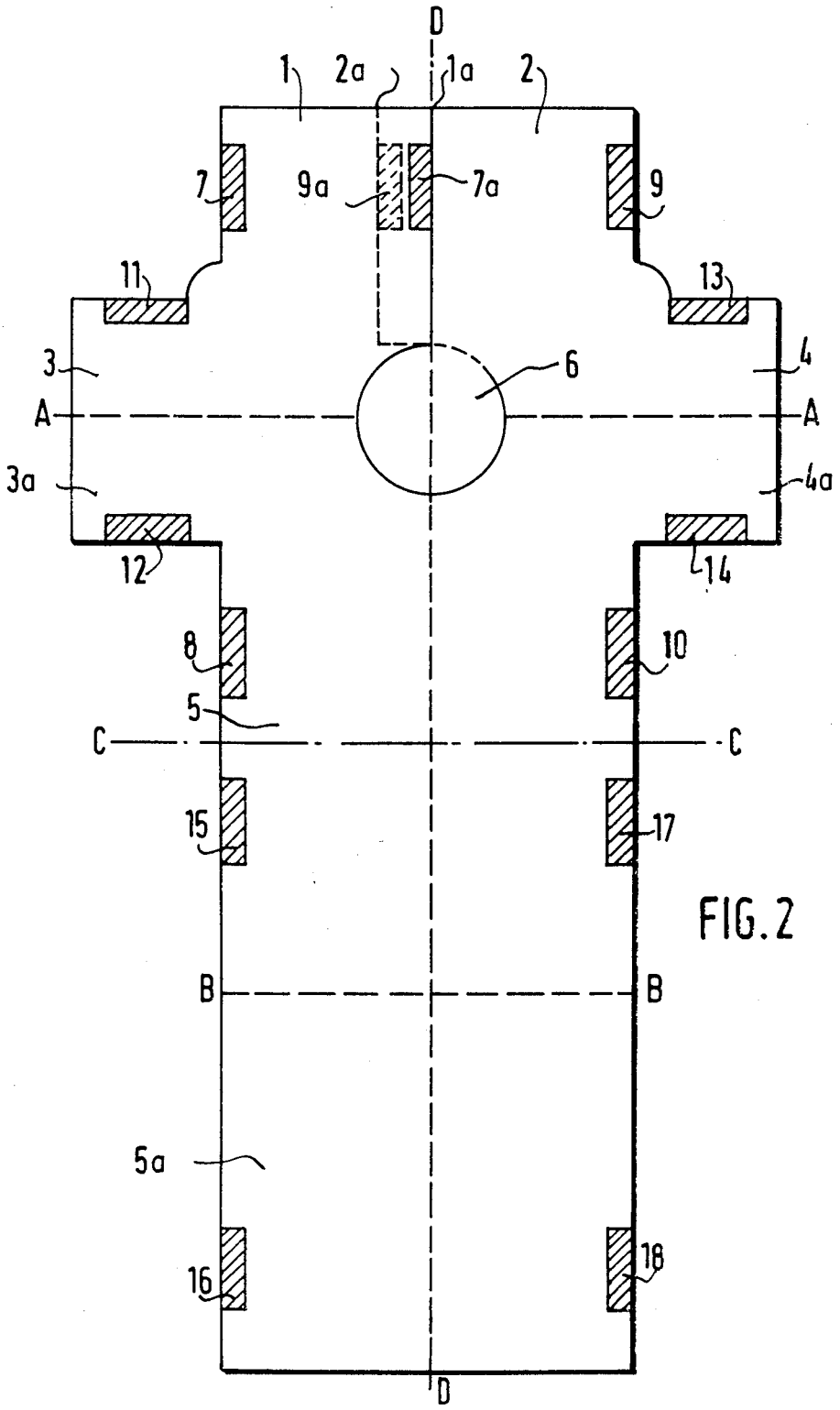
FIG. 2 illustrates a garment of the present invention, showing also the bottom of the lower part.

FIG. 2 represents a garment according to the invention, completely unfolded on a plane where:

the references 1 to 14 have the meanings mentioned in FIG. 1;

and the B—B axis is the foot crease axis as above define;

5*a* represents the bottom of the lower part, which is foldable according to the B—B axis on the front of the baby and to be attached to the back of the garment by means of the fasteners 15 and 16, on the one hand, 17 and 18 on the other hand.

In this embodiment, it is possible in a first stage firstly to fold the elements 1 and 2 on to part 5 along the shoulder crease axis, then in a second stage, to fold up the part 5*a* on to the part 5 along the foot crease axis or to carry out both stages, the other way around, the system of fasteners being then accordingly adapted.

Figure 3:
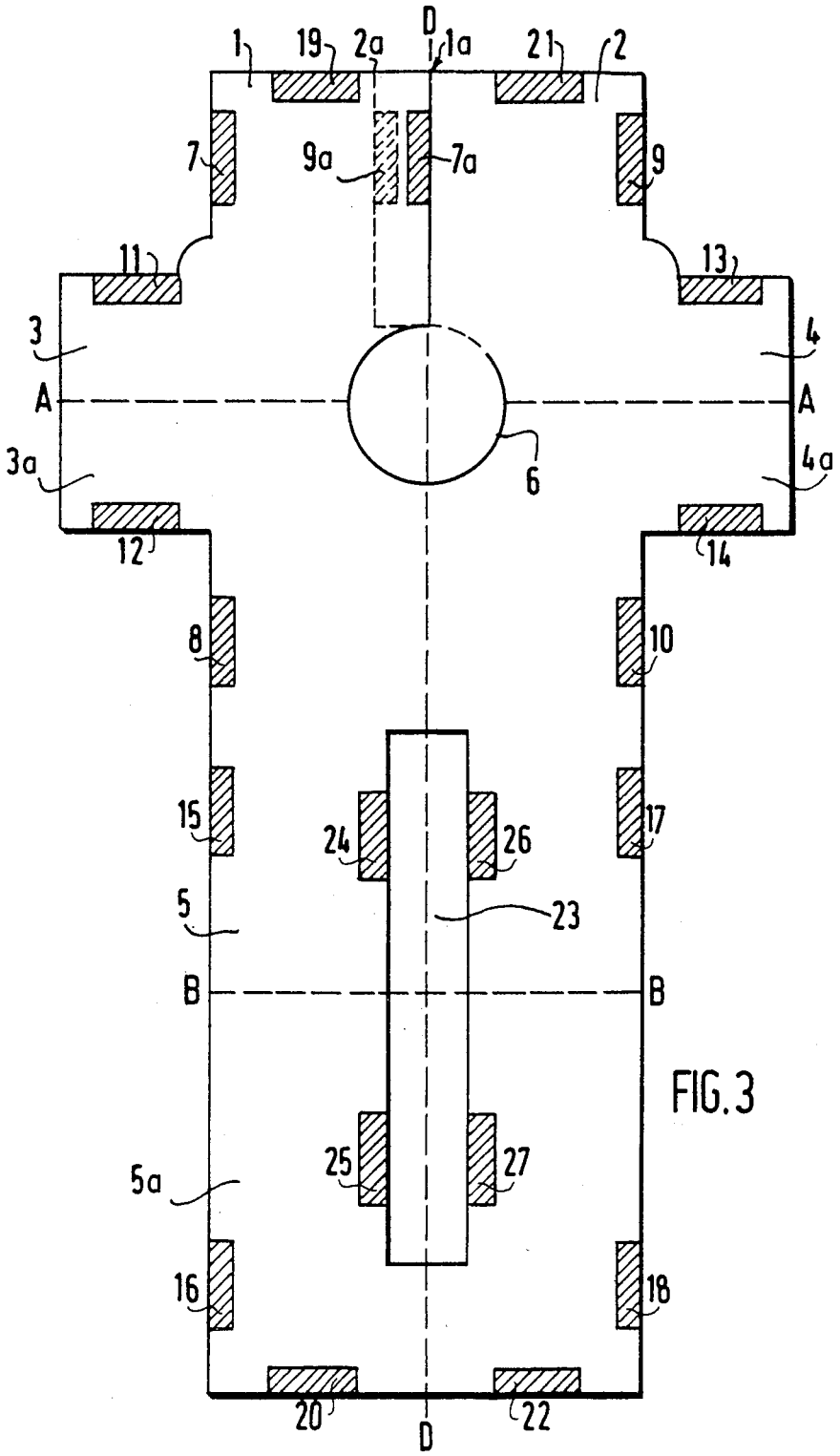
FIG. 3 shows a garment of the present invention wherein the bottom of the lower part comprises a split, which after folding up provides individual accommodations for the legs.

FIG. 3 represents a garment according to the invention, completely unfolded on a plane and in which the references 1 to 18 have the above mentioned meaning in FIGS. 1 and 2 and in which 23 represents a symmetrical split with respect to the foot crease axis, so that after folding up part according to B—B of part 5*a* onto part 5, two individual accomodations are obtained for the feet and legs of the baby, by means of the system of fasteners 19, 21 on the one hand and 20, 22 on the other hand, and respectively attached to the upper edge of the upper part, and to the lower edge of the lower part, the frontal and dorsal parts of each of these accomodations being attached together by means of fasteners 24 and 25, on the one hand, 26 and 27, on the other hand.

Figure 4:
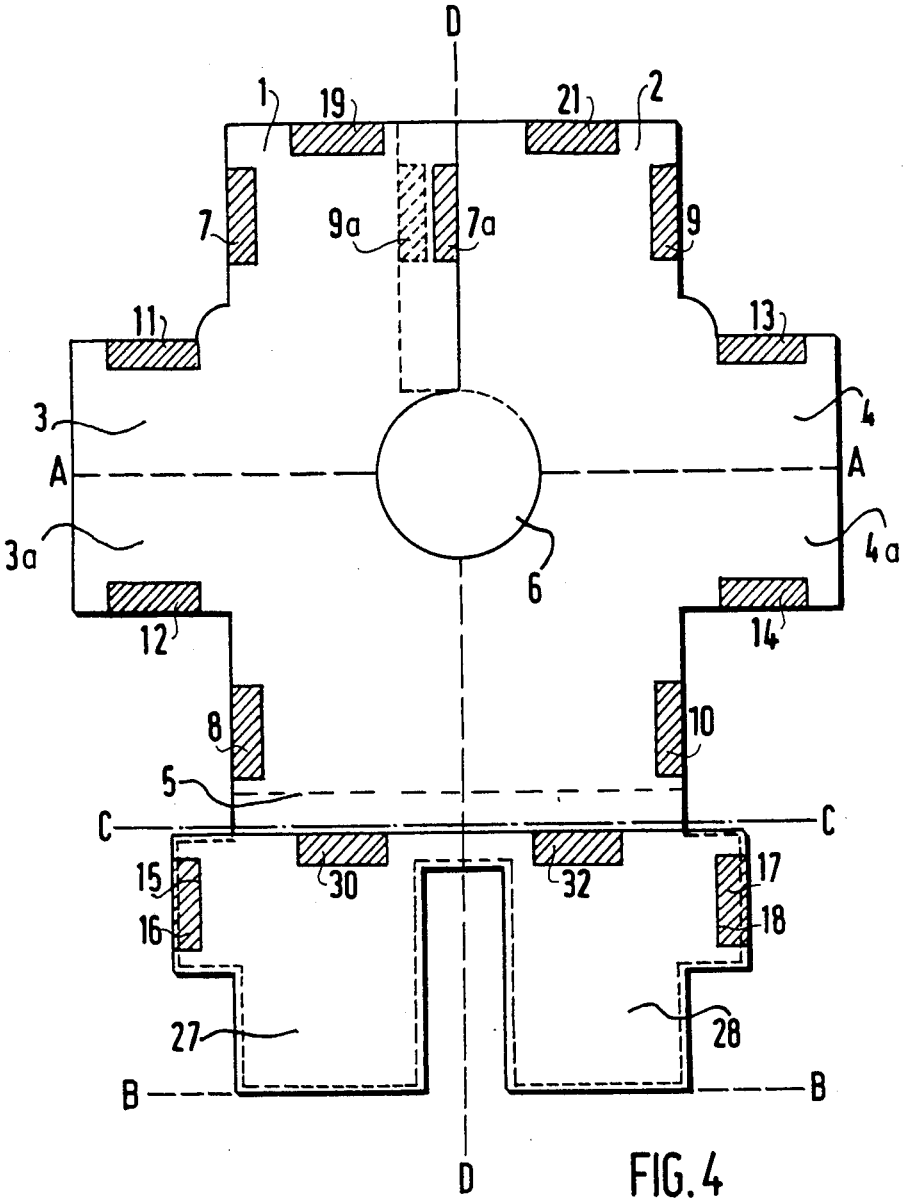
FIG. 4 shows a garment of the present invention comprising pants with pre-attached legs.

FIG. 4 represents a garment according to the invention in which the part which is situated below the C—C axis has been described in the preceeding figures and in which the part between the C—C axis and the B—B axis is shaped like pants. The legs of the pants 27 to 28 are pre-attached up to about the calf and the fasteners 17 and 18 on the one hand, 15 and 16 on the other hand are used to attach the frontal upper part and the dorsal upper part of each of the legs of the pants, the pants are attached to the upper elements 1 and 2 by means of fasteners 19 and 30 on the one hand, 21 and 32, on the other hand.

Figure 5:
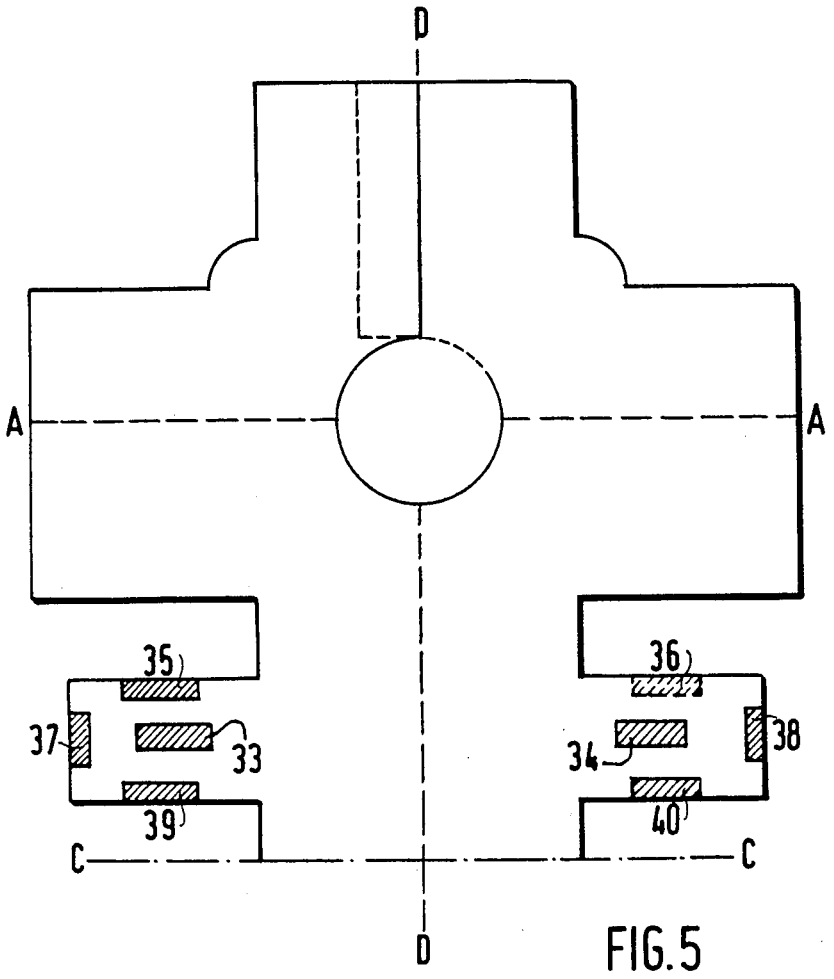
FIG. 5 illustrates the details of the lateral parts situated below the parts forming the sleeves.

FIG. 5 represents more particularly the additional lateral parts which are situated under the lateral parts which form the sleeves.

These additional lateral parts which form the sleeves, folded on to each other along the longitudinal axis, cross each other on the baby's abdomen and are kept attached by means of a system of fasteners for instance 33, 34 or 35, 36 or 37, 38 or 39, 40 or a combination of these systems.

Figure 6:
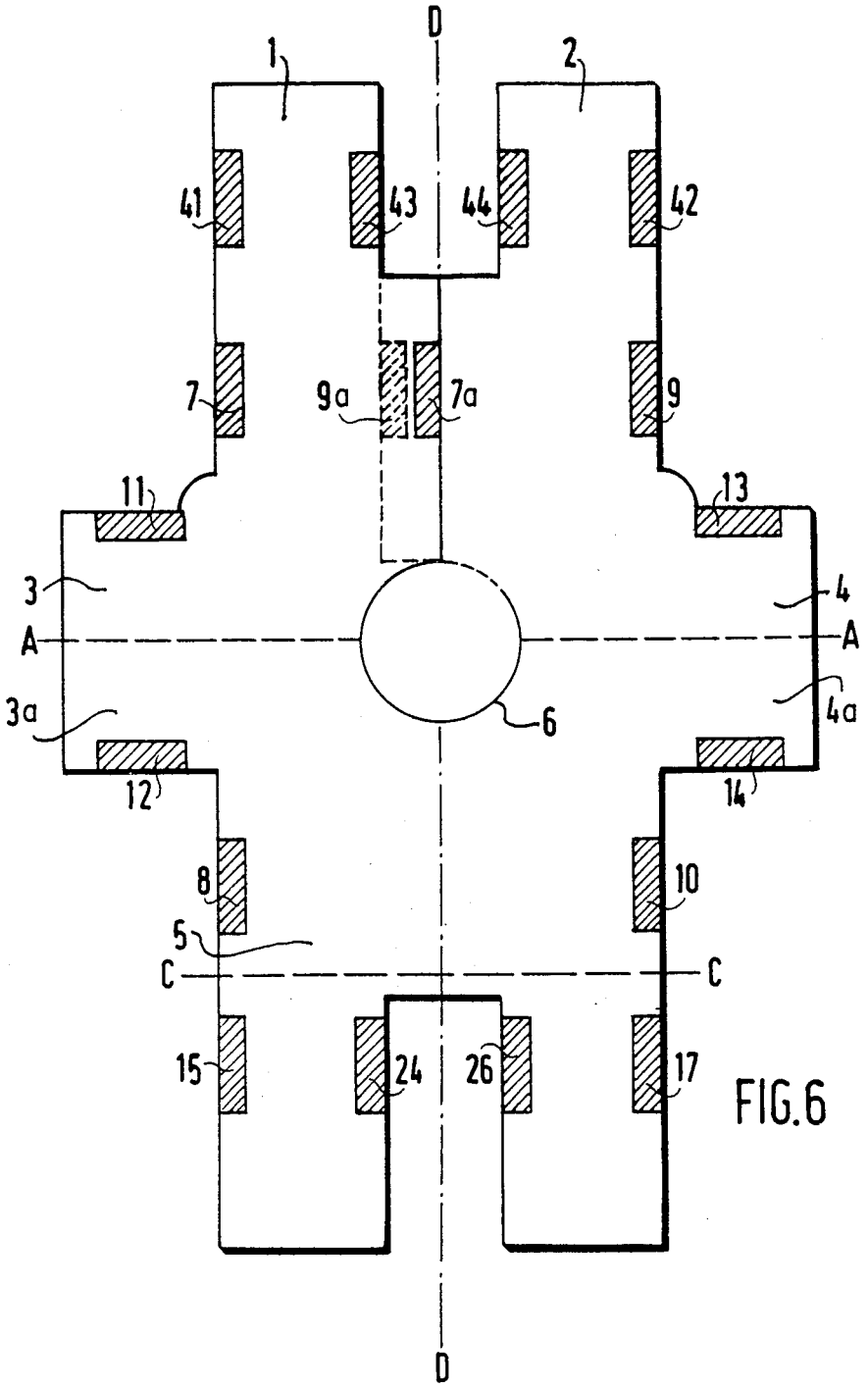
FIG. 6 shows a garment wherein the upper part and the lower part are symmetrical with respect to the shoulder axis.

FIG. 6 is a garment according to the invention which is completely unfolfed on a plane the said garment being symmetrical on the one hand with respect to the A—A transversal axis and on the one hand with respect to the D—D longitudinal axis, in whic the references 1 to 14 have the meanings given for FIGS. 1, 2, 3 and 4 and in which the upper part is such that each of the upper elements 1 and 2 has a length which is equal at most to the length of the baby, measured from neck to feet and comprises, on a length which is equal to about at most the lenght of the baby's leg and at least about a quarter of the length of the baby's leg, an element which is substantially rectangular, recessed with respect to the split and in which the lower part has a length at most equal to the length of the baby, measured from neck to feet, the said lower part comprising a length which is at most equal to the length of the baby's leg and at least equal to about a quarter of the length of the baby's leg, two elements which are substantially rectangular, which are identical to each other and identical to the elements which are substantially rectangular of the upper part and on the one hand separated from each other by a split, and on the other hand recessed with respect to the longitudinal axis and in which after folding along the shoulder crease axis of the upper part, each of the elements which are substantially rectangular on the upper part cover each of the substantially rectangular elements of the lower parts to form pants the leg length of which vary according to the length of the said rectangular parts.

On the one hand, 15 and 41 and on the other hand 17 and 42 represent the system of fasteners, which enables gathering the external sides of the lower and upper rectangular parts, and on the one hand 24 and 43 and on the other hand 26 and 44 gathering the internal sides of the lower and upper rectangular parts.

Figure 7:
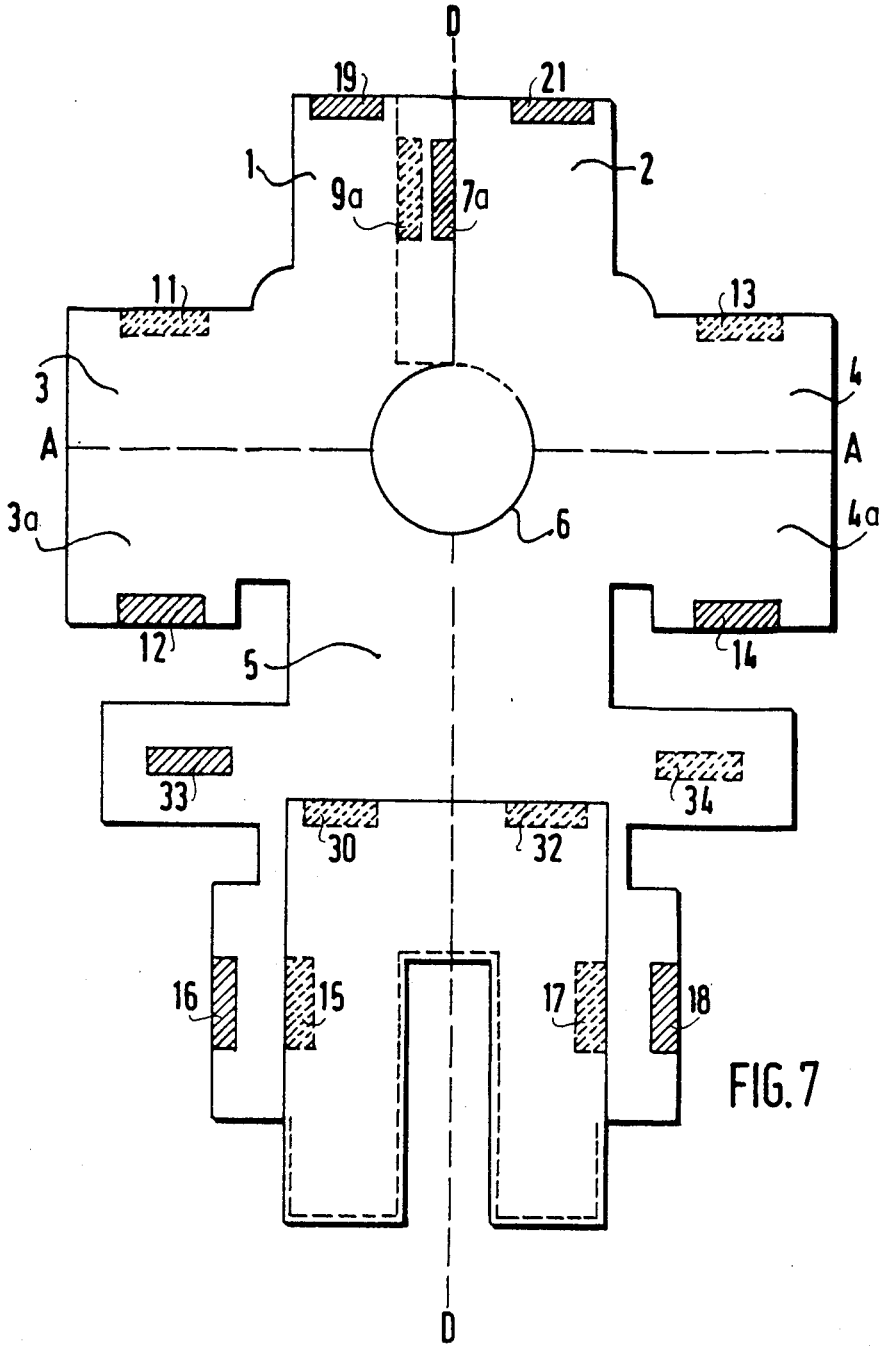
FIG. 7 illustrates a garment comprising parts with pre-attached legs and lateral parts under the parts forming the sleeves.

FIG. 7 represents a garment according to the invention, in which the references, 1, 2, 3, 3*a*, 4, 4*a*, 5, 6, 7*a*, 9*a*, 11, 12, 13 and 14 have the meaning as mentioned in the previous figures comprising additional lateral parts, which can be attached to each other, after being folded over the baby's abdomen by means of the system of fasteners 33 and 34; the lower part of the garment is constituted by pants, the legs of which are pre-attached on their internal sides and are pre-attached up to about the baby's ankle, on their external side, and the external sides of which from the ankle up to the upper edge of the pants are free; the respective frontal and dorsal parts of each of these legs can be attached by means of systems of fasteners 15, 16 on the one hand 17 and 18 on the other hand. It is possible to notice the cutting of the material on which the fasteners 16 and 18 are attached.

The upper elements 1 and 2, after having been folded on to the pants, are maintained attached to the pants by means of the fasteners 19, 30 on the one hand and 21, 32 on the other hand.

It is to be noted that the additional lateral parts are in this case sufficient to maintain the upper elements 1 and 2 with respect to the part 5 of the back, but is also possible to encompass a system of fasteners 7, 8, 9 and 10 as it has been mentioned in the figures below.

Figure 8:
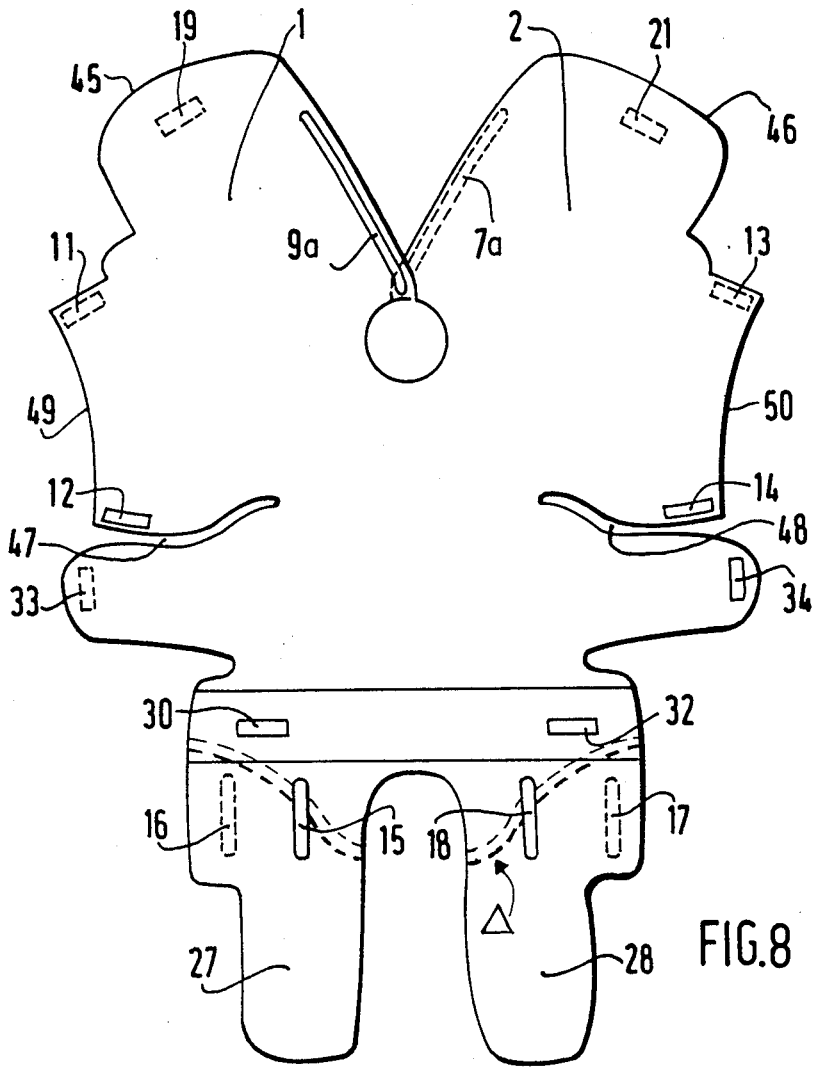
FIG. 8 shows a garment with rounded sides and edges.

FIG. 8 represents a garment according to the invention in whichh the references 1, 2, 7*a*, 9*a*, 11, 12, 13, 14, 15, 16, 17, 18, 19, 21, 27, 28, 30, 32, 33 34 have the meaning as mentioned in FIG. 4, and in which the free side of the upper part (sides 45 and 46) are round, the lower part of the lateral parts (sides 47 and 48) are round and the sides substantially parallel to the longitudinal axis (sides 49 and 50) are curved.

Figure 9A:
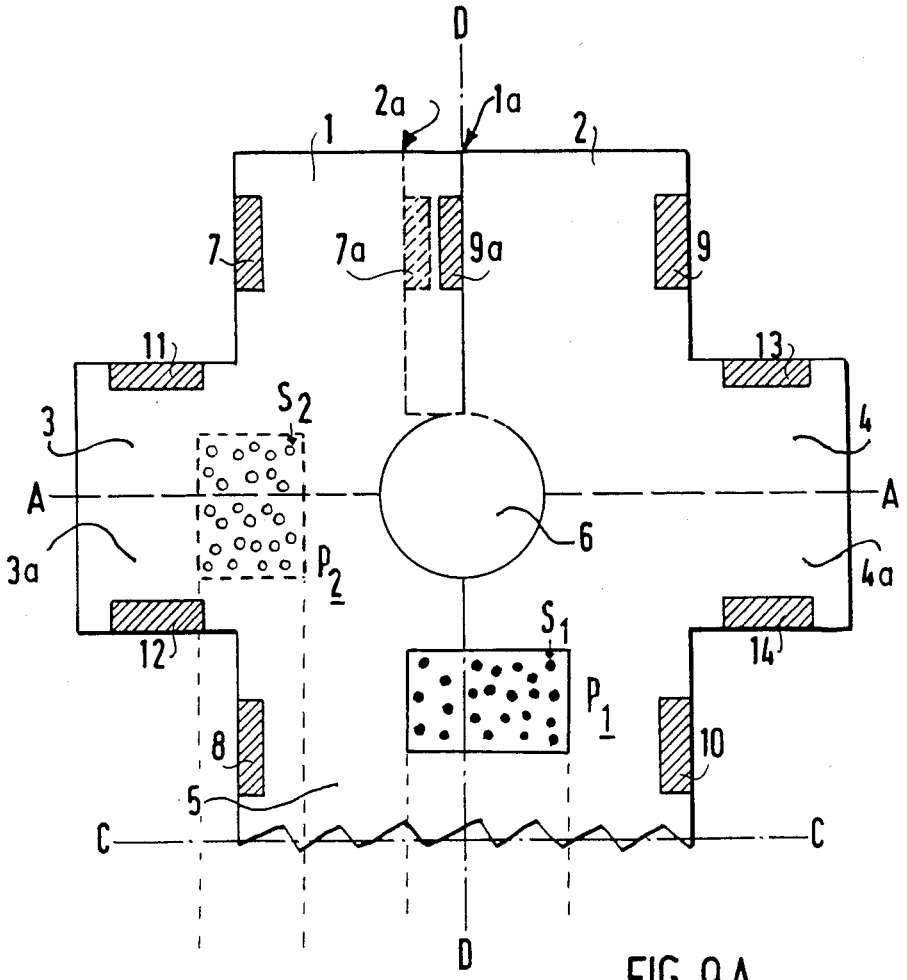
FIG. 9A illustrates a garment according to the invention with representations of therapeutical products.

FIG. 9A represents a garment according to the invention as represented in FIG. 1 and in which the references have the meaning indicated in FIG. 1 and in which:

P1 represents any area of the garment comprising a therapeutical product S1, schematized with black dots, this said area P1 located on the internal surface of the garment can be integrated to the internal surface, or attached, in a releasable way or in an unreleasable way on the internal surface, P2 represents any area of the garment the layer of which located just under the internal surface of the garment is impregnated with a therapeutical product S2, schematized with small circles.

Figure 9B:
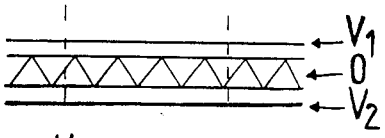
FIGS. 9B and 9C are enlarged, highly schematic cross-sectional view of portions of FIG. 9A.
Figure 9C:
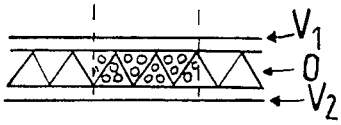

FIGS. 9B and 9C represent respectively areas P1 and P2 of the garment in section according to the thickness of the garment, i.e. constituted of three different layers, that is to say an internal surface, an intermediate layer and an external layer.

The line V1 corresponds to the internal surface of the garment in direct contact with the skin, the part 0, delimited by two lines parallel to each other and covered by jagged lines, corresponds to the intermediate layer of the garment, and the line V2 corresponds to the external surface of the garment.

In FIG. 9B, the therapeutical product S1 is inside or on the surface corresponding to V1.

In FIG. 9C, the therapeutical product S2 located into layer 0 is liable to diffuse or to migrate in the surface corresponding to V1.

Of course, the whole garment can comprise a therepeutical product as indicated respectively for therapeutical substances S1 and S2.

Figure 10:
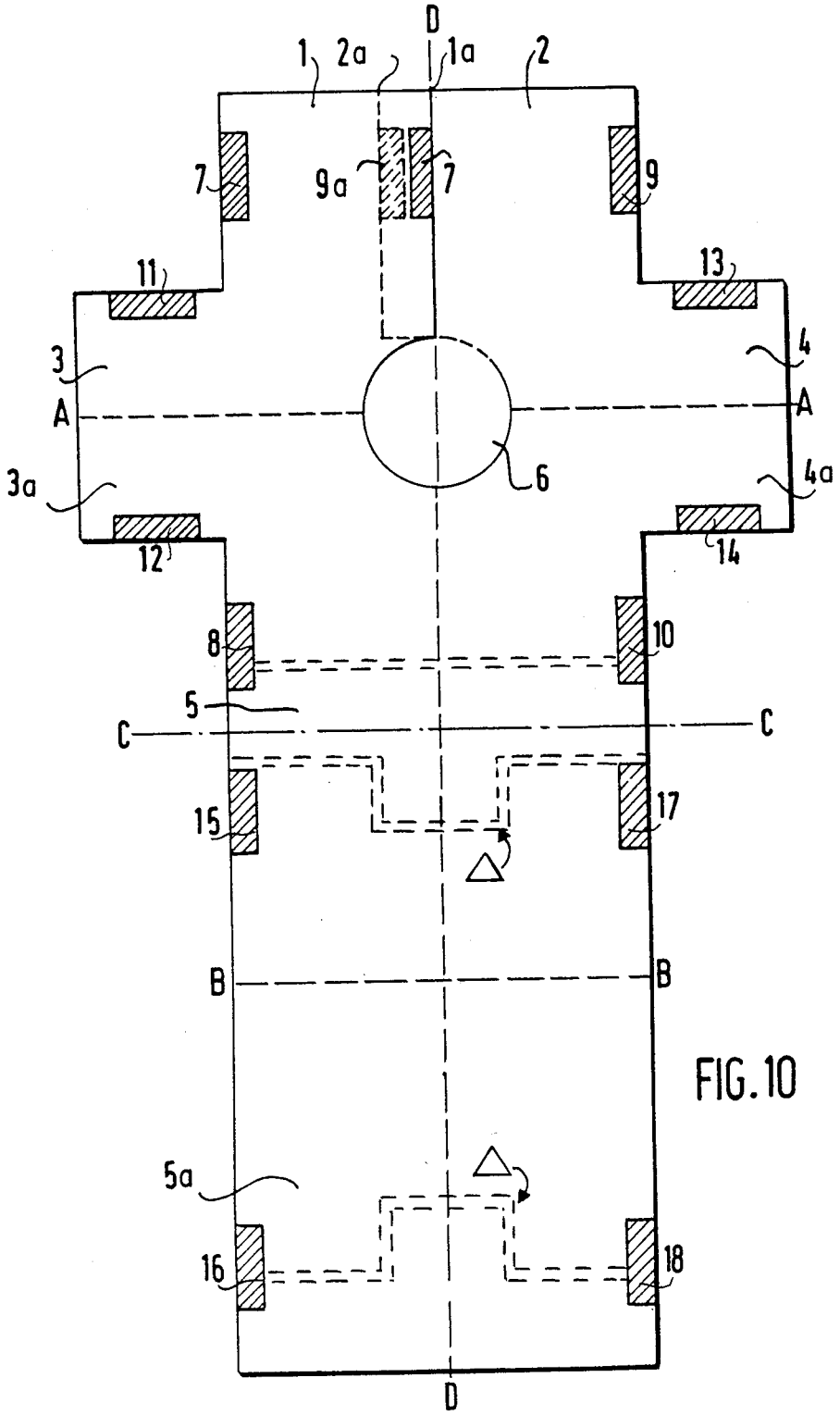
FIG. 10 illustrates a garment according to the invention of the type as shown in FIG. 2, with a representation for the placement of diaper pants.

FIG. 10 represents a garment according to the garment of the invention, as represented in FIG. 2, and in which the reference have the meaning indicated in FIG. 2 and in which:

the diaper or diaper pants, were schematically represented by Δ (in double dotted lines), and can be removable or not, when the garment is of woven material or of non-woven material, or integrated to the said garment when the garment is of a non-woven material.

A part of the diaper or diaper pants is on the dorsal part 5 whereas the other part of the diaper or the diaper pants is on the frontal part 5*a*.

EXAMPLE 1

A garment according to the invention such as represented on FIG. 10 before dressing has been manufactured.

The different squares represent the Velcro dots.

Figure 11:
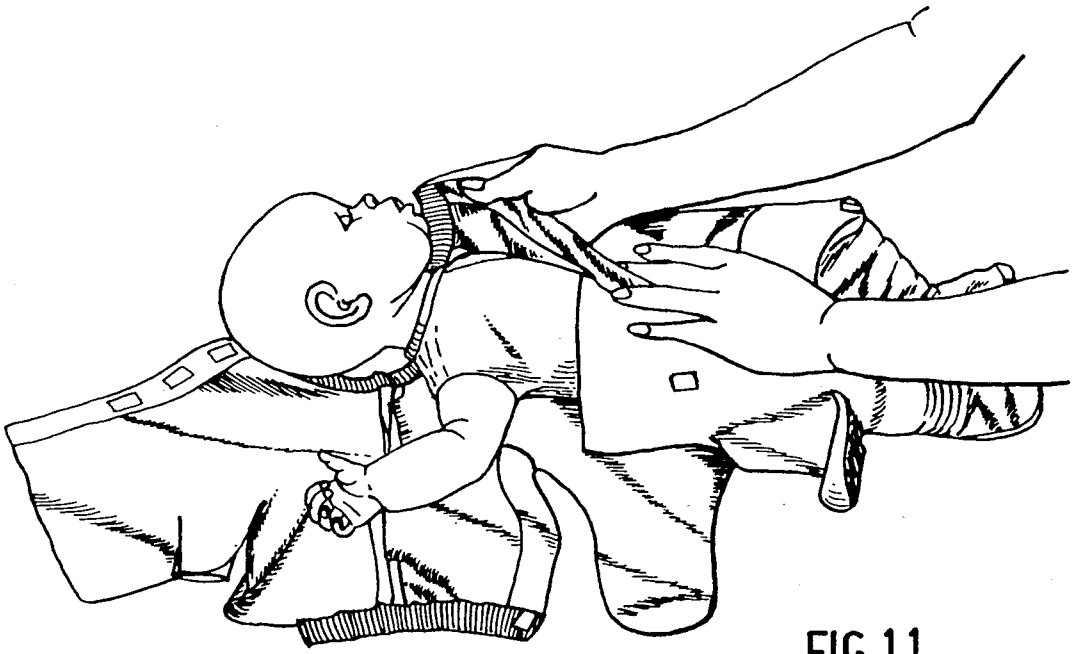
FIG. 11 is a perspective view illustrating the dressing of a baby with the garment of the present invention.

FIG. 11 represents the dressing of the baby with the garment according to the invention. The baby's head is put on the hole and the pants are put on the baby, then the different elements are foled to form the front and the sleeves.

FIGS. 12.1 and 12.2 represent the garment according to the invention in section, in the part where it comprises the diaper or diaper pants.

The case which is considered is when the garment comprises three layers, that is to say an internal surface V1, an intermediate layer and an external surface V2.

FIG. 12.1 corresponds to a garment of woven material or of non-woven material.

The diaper or diaper pants is fixed to the internal surface V1, directly in contact with the child's skin. This layer Δ can be releasable with respect to V1.

FIG. 12.2 corresponds to a garment of non-woven material, the diaper or diaper pants being incorporated or integrated to the structure itself of the garment.

In this case, the intermediary part 0 presents a part Δ which corresponds to the diaper or to the diaper pants, which part Δ is constituted of alternate absorbent and impermeable and advantageously presents the structure of a classical diaper.

In this case, the intermediate part 0 presents a curved part Δ which corresponds to the diaper or diaper pants, this said part Δ is constituted of alternate absorbant and impermeable parts and presents advantageously the structure of a classical diaper.

What is claimed:

1. A garment that can be put on a baby without having to slip the baby's head through a neck opening in said garment or slip the baby's arms through sleeves in said garment; said garment comprising:

a single piece of material which, when laid out flat, is in the shape of a cross; said cross having a longitudinal axis and a first transverse axis which intersect at a center of said cross; said cross comprising four quadrilateral forms; two of said forms projecting transversely and two of said forms extending longitudinally from said center of said cross; each of said forms having three sides free and a fourth side adjoining the remainder of said piece of material;

a first opening being provided about said center of said cross; and first opening serving as said neck opening when the baby is within said garment;

a slit being provided in one of said longitudinally projecting forms; said slit extenidng longitudinally from a transversely extending free side of said one longitudinally projecting form to said first opening; said slit dividing said one longitudinally projecting form into two adjacent form portions;

said piece of material being foldable about said first transverse axis and about the baby to form each of said two transversely projecting forms into front and back portions of a sleeve and to form said longitudinally projecting forms into front and back portions of said garment;

releasable fastener means being provided along two transversley extending free sides of each of said transversely projecting forms, on longitudinally opposite sides thereof, for fastening said front and back portions of said sleeves to one another along said transversely extending free sides to close said sleeves about the arms of the baby when the baby is within said garment;

said garment further comprising: releasable fastener means for fastening said front and back portions of said garment to one another to close said garment at its sides about the baby within said garment; and releasable fastener means for fastening said two adjacent form portions of said one longitudinally projecting form to each other along said slit to close said slit with the baby within said garment, and at least one of said front and back portions including a diaper means.

2. A garment according to claim 1, said diaper means comprising diaper layers formed integrally into the back portion of the garment.

3. A garment according to claim 2, wherein the diaper layer is formed on the internal surface of the garment directly in contact with the baby's skin.

4. A garment according to claim 2, wherein the garment is formed of at least three layers in the vicinity of the diaper means, and wherein the intermediate layer comprises the diaper layer.

5. A garment according to claim 4, wherein said intermediate diaper layer comprises alternate absorbent and impermeable layers.

6. A garment according to claim 1, said diaper means comprising diaper pants releasably attached to the internal surface of the said back portion.

7. A garment according to claim 6, wherein the diaper pants are made of a non-woven disposable material.

8. A garment according to claim 2, wherein the garment is made of woven material, and the diaper layer comprises knit material integrally secured to the internal surface of the back portion of the garment.

9. A garment according to claim 2, wherein the garment is made of a non-woven material, and said diaper layers comprise layers of non-woven materials secured to the internal surface of the back portion.

10. A garment according to claim 2, including impermeable areas separating the diaper means from the remainder of the garment.

11. A garment according to claim 2, wherein the garment is formed of three non-woven layers, and wherein the intermediate non-woven layer comprises diaper material on its internal surface.

12. A garment according to claim 2, wherein the garment comprises two non-woven layers and the diaper material is secured to the inside non-woven layer in the space between the two layers.

13. A garment according to claim 2, wherein the garment comprises three non-woven layers and the intermediate layer having an additional thickness in the vicinity of the diaper means.

14. A garment according to claim 2, wherein the garment comprises three non-woven layers and wherein the intermediate layer comprises diaper material secured thereto.

15. A garment according to claim 2, including means such as elastics or the like for shrinking the garment at the vicinity of the diaper area to provide this area with a shape of diaper pants.

16. A garment that can be put on a baby without having to slip the baby's head through a neck opening in said garment or slip the baby's arms through sleeves in said garment; said garment comprising:

a single piece of material which, when laid out flat, is in the shape of a cross; said cross having a longitudinal axis and a first transverse axis which intersect at a center of said cross; said cross comprising four quadrilateral forms; two of said forms projecting rransversely and two of said forms extending longitudinally from said center of said cross; each of said forms having three sides free and a fourth side adjoining the remainder of said piece of material;

a first opening being provided about said center of said cross; said first opening serving as said neck opening when the baby is within said garment;

a slit being provided in one of said longitudinally projecting forms; said slit extending longitudinally from a transversely extending free side of said one longitudinally projecting form to said first opening; said slit dividing said one longitudinally projecting form into two adjacent form portions;

said piece of material being foldable about said first transverse axis and about the baby to form each of said two transversely projecting forms into front and back portions of a sleeve and to form said longitudinally projecting forms into front and back portions of said garment;

releasable fastener means being provided along two transversely extending free sides of each of said transversely projecting forms, on longitudinally opposite sides thereof, for fastening said front and back portions of said sleeves to one another along said transversely extending free sides to close said sleeves about the arms of the baby when the baby is within said garment;

said garment further comprising: releasable fastener means for fastening said front and back portions of said garment to one another to close said garment at its sides about the baby within said garment; and releasable fastener means for fastening said two adjacent form portions of said one longitudinally projecting form to each other along said slit to close said slit with the baby within said garment;

and at least a portion of the garment comprising a structure for supporting a therapeutical product, said structure comprising means for permitting a therapeutical product to migrate into contact with the skin.

17. A garment according to claim 16, wherein the structure is located on the internal surface of the garment in direct contact with the skin.

18. A garment according to claim 17, wherein a therapeutical product is coated, covered or impregnated in said structure.

19. A garment according to claim 17, wherein a therapeutical product is absorbed into said structure.

20. A garment according to claim 17, wherein said structure is integrally connected to the internal surface of the garment.

21. A garment according to claim 17, wherein the structure is releasably attached to the internal surface of the garment.

22. A garment according to claim 16, wherein the garment comprises at least two layers, and the said structure is attached to the innermost layer, on the surface thereof opposite from the surface which contacts the skin.

23. A garment according to claim 22, wherein a therapeutical product is coated, covered or impregnated in said structure.

24. A garment according to claim 22, wherein a therapeutical product is adsorbed into said structure.

25. A garment according to claim 22, wherein said structure is integrally connected to the internal surface of the garment.

26. A garment according to claim 22, wherein the structure is releasably attached to the internal surface of the garment.

27. A garment according to claim 16, wherein the structure includes a therapeutical product for preventive treatment or curative treatment of skin injuries, dermatological injuries, sores, burns or bed sores.

28. A garment according to claim 16, wherein the garment comprises at least three layers, an internal layer, an intermediate layer and an external layer, and wherein the said structure is formed in the intermediate layer.

29. A garment according to claim 28, wherein the said structure includes a therapeutical material.

* * * * *